US012727650B2

(12) United States Patent
Owings et al.

(10) Patent No.: US 12,727,650 B2
(45) Date of Patent: Sep. 8, 2026

(54) FASTENING ASSEMBLY FOR A CLOSURE MECHANISM

(71) Applicant: NIKE, Inc., Beaverton, OR (US)

(72) Inventors: Andrew A. Owings, Beaverton, OR (US); Nicholas Buck, Camas, WA (US); Peter V. Nikiforov, Camas, WA (US); Shawn M. Close, Camas, WA (US); Jeffery B. Kennedy, Camas, WA (US)

(73) Assignee: NIKE, Inc., Beaverton, OR (US)

( * ) Notice: Subject to any disclaimer, the term of this patent is extended or adjusted under 35 U.S.C. 154(b) by 65 days.

(21) Appl. No.: 18/739,628

(22) Filed: Jun. 11, 2024

(65) Prior Publication Data

US 2024/0423332 A1 Dec. 26, 2024

Related U.S. Application Data

(60) Provisional application No. 63/522,065, filed on Jun. 20, 2023.

(51) Int. Cl.
*A44B 19/38* (2006.01)
*A44B 19/26* (2006.01)

(52) U.S. Cl.
CPC ..... *A44B 19/26* (2013.01)

(58) Field of Classification Search
CPC ..... A44B 19/26; A44B 19/24; A44B 19/38; A44B 19/388; A44D 2203/00
See application file for complete search history.

(56) References Cited

U.S. PATENT DOCUMENTS 2,093,973 A * 9/1937 Clark ..... A44B 19/38 24/433
2,203,005 A * 6/1940 Wittenberg ..... A44B 19/38 24/434
4,078,279 A * 3/1978 Heimberger ..... A44B 19/38 24/434
4,139,927 A * 2/1979 Heimberger ..... A44B 19/38 24/434
4,221,026 A * 9/1980 Kanzaka ..... A44B 19/38 24/433
4,742,603 A * 5/1988 Kasai ..... A44B 19/38 24/433
5,333,362 A * 8/1994 Gillioz ..... A44B 19/38 24/433

(Continued)

FOREIGN PATENT DOCUMENTS

CN 112602996 A 4/2021
WO 2022/137471 A1 6/2022

OTHER PUBLICATIONS

International Search Report and Written Opinion received for PCT Patent Application No. PCT/US2024/034546, mailed on Oct. 23, 2024, 12 pages.

*Primary Examiner* — Jack W Lavinder
(74) *Attorney, Agent, or Firm* — Shook, Hardy & Bacon L.L.P.

(57) ABSTRACT

Aspects herein are directed to a releasable coupling device having a first housing structure that includes a temporary magnet and a second housing structure that includes a permanent magnet. The first housing structure is receivable by a receiving receptacle of the second housing structure. The releasable coupling device may be included as part of a slide fastener assembly having two slider tapes.

25 Claims, 14 Drawing Sheets

(56) References Cited

U.S. PATENT DOCUMENTS

| | | | | |
|---|---|---|---|---|
| 6,088,888 | A * | 7/2000 | Oda | A44B 19/38 24/433 |
| 6,421,887 | B1 * | 7/2002 | Oda | A44B 19/38 24/433 |
| 7,320,158 | B2 * | 1/2008 | Deto | A41F 1/002 24/433 |
| 11,627,784 | B2 * | 4/2023 | Tung | A44B 19/24 24/433 |
| 11,825,919 | B2 * | 11/2023 | Naka | A44B 19/262 |
| 2003/0115725 | A1 * | 6/2003 | Matsumoto | A44B 19/388 24/433 |
| 2006/0075612 | A1 * | 4/2006 | Wu | A44B 19/388 24/433 |
| 2008/0040901 | A1 * | 2/2008 | Himi | A44B 19/38 24/433 |
| 2010/0313387 | A1 * | 12/2010 | Peters | A44B 19/38 24/381 |
| 2012/0000040 | A1 * | 1/2012 | Ogura | A44B 19/382 24/391 |
| 2013/0061436 | A1 * | 3/2013 | Peters | A44B 19/384 24/430 |
| 2013/0074292 | A1 * | 3/2013 | Nozaki | A44B 19/26 24/415 |
| 2020/0015554 | A1 * | 1/2020 | Takazawa | A44B 19/36 |
| 2021/0289893 | A1 * | 9/2021 | Owings | A44B 19/388 |
| 2023/0404222 | A1 * | 12/2023 | Tung | A44B 19/38 |

* cited by examiner

FASTENING ASSEMBLY FOR A CLOSURE MECHANISM

CROSS-REFERENCE TO RELATED APPLICATION

This application titled "Fastening Assembly for a Closure Mechanism" claims the benefit of priority of U.S. Application No. 63/522,065, filed Jun. 20, 2023, and titled "Fastening Assembly for a Closure Mechanism". The entirety of the aforementioned application is incorporated by reference herein.

TECHNICAL FIELD

Aspects herein are directed to a fastening assembly for a slide closure mechanism, such as a zipper.

BACKGROUND

By way of background, slide closure assemblies may include a slider body and two sets of coupling elements, such as rails or zipper teeth along a tape. The opposing teeth may be coupled or decoupled when the slider body traverses coupling elements of both sets. To perform this function, the slider body is required to be properly aligned with both sets of coupling elements. Some types of slide closure assemblies, such as those that may be completely unfastened, include a slider body that is permanently mounted to one set of coupling elements and brought into contact with the other set of coupling elements by a user.

BRIEF DESCRIPTION OF THE DRAWINGS

Examples of aspects herein are described in detail below with reference to the attached drawing figures, wherein.

DETAILED DESCRIPTION

Figure 1:
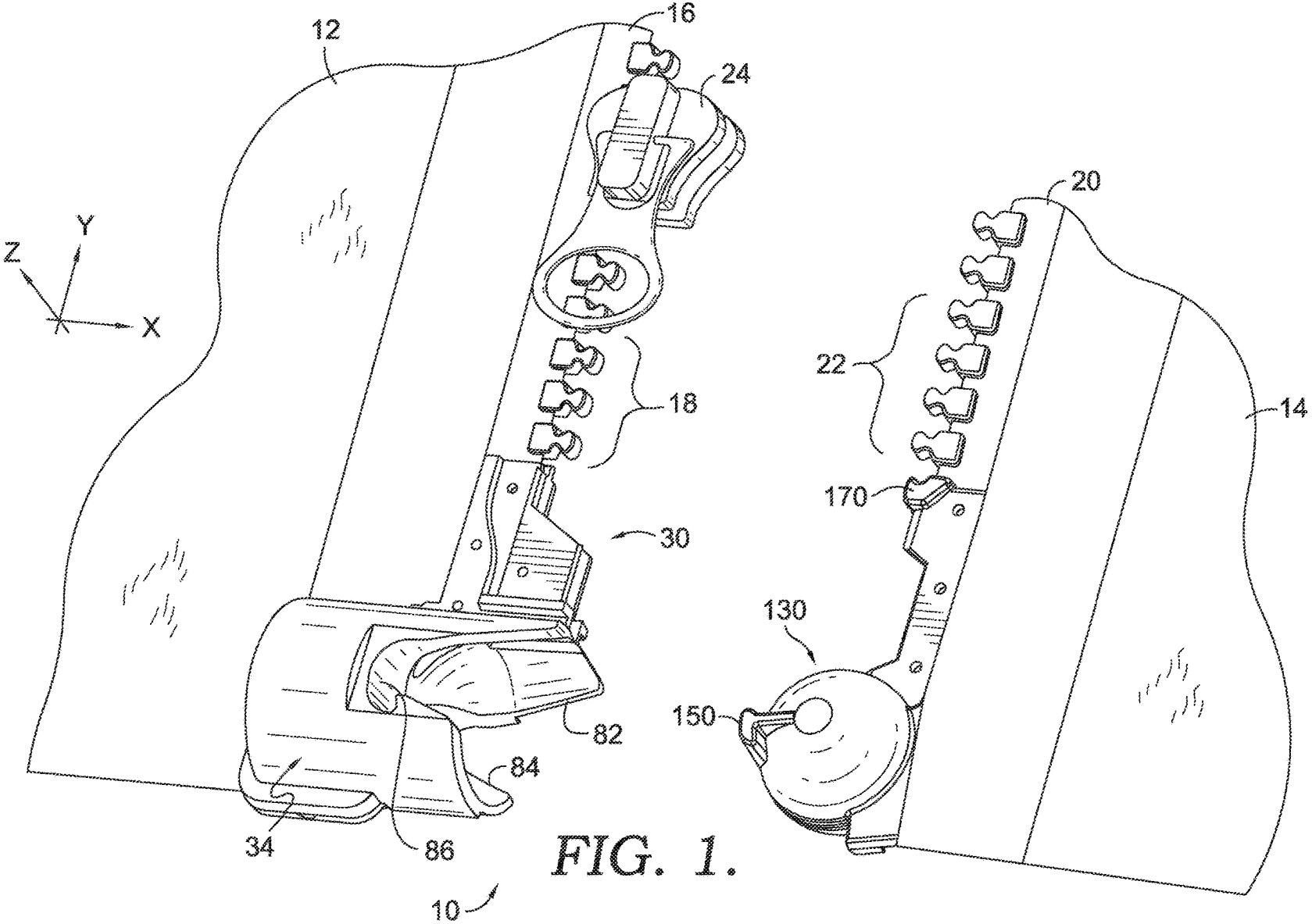
FIG. 1 illustrates a perspective view of front side of fastener assembly coupled to a garment, accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies.

Slide closure assemblies are used to releasably fasten two sets of coupling elements (such as opposed sets of coupling teeth) and may be incorporated into releasable fastening systems of articles of apparel. Such releasable fastening systems may be used in articles to releasably fasten two portions to one another and/or may be utilized in connection with various features and aspects of articles including, but not limited to, pockets, vents, collars, sleeves, openings (e.g., arm, pant leg, torso, neck or waist), donning, removal, comfort, fit, securement, and the like. In some cases, releasable fastening systems are fully releasable such that two portions of the article can be completely separated from one another, which, for instance, allows for easier donning and doffing of the article. Such releasable fastening systems typically include slide closure assemblies with a slider body that is permanently coupled to, for example, a first slider tape having a first set of coupling elements and is removably coupled (i.e., may be coupled and decoupled) to a second set of coupling elements on a second slider tape. However, aligning the slider body with the coupling elements requires the user to manually position the slider body relative to the coupling elements, which may involve gripping and positioning or aligning the slider body and the two sets of coupling elements. In some instances, manually lining up the slider body to a set of coupling elements may be difficult as it requires a user to grip and move both the slider body and the sets of coupling elements. For instance, the user may be required to steadily hold the slider body and a first set of coupling elements to which the slider body is permanently mounted while simultaneously guiding an end of a second set of coupling elements into a throat of the slider body. These manual operations usually involve both of the user's hands and can be challenging to perform, especially for those with limited hand mobility. The task is even more challenging when performed by a user having limited dexterity and/or mobility in his or her hands or arms.

Aspects herein provide a fastener assembly for a slide closure mechanism that allows a user to more easily align a slider body with opposing coupling elements, such that a user may more easily use the slide closure mechanism, such as a zipper. At a high level, the fastener assembly includes a first structure housing a magnet and a second structure housing a magnetically attractable material. The first and second structures are configured to be releasably coupled such that the first and second structures may be coupled when positioned within a coupling distance (e.g., moving the first and second structures toward one another) and may be uncoupled when repositioned beyond the coupling distance (e.g., moving the first and second structures away from one another to a position in which the first and second structures are separated by a distance greater than the coupling distance). In one aspect, the magnetically attractable material is not attracted to the magnet at a distance that is greater than the coupling distance, which affords functional advantages to an article of apparel that includes the fastener assembly. For example, use of the magnetically attractable material may prevent inadvertent coupling of the first and second structures when a wearer desires to maintain the article of apparel in an open state. The first and second structures include guide features that align the first structure with the second structure as the first and second structures are moved toward each other. Further, the first structure and the second structure include locking features that maintain the relative position of the first structure to the second structure when in a coupled state, such that a slider body associated with the zipper can be utilized to couple and decouple the opposing teeth of the zipper.

A fastening assembly for a slide closure mechanism, such as a zipper, is provided that allows easier alignment of the two sides of the slide closure mechanism. In some aspects, the zipper includes a first slider tape and a second slider tape, each of which includes a series of interdigitating teeth along a zipper axis. In some aspects, the fastener assembly comprises a first structure comprising; a first portion defining a first internal cavity; and a second portion defining a first alignment zone. The second portion may have a first end adjacent the first internal cavity, an upper surface extending from the first end to an upper outer end, a locking notch adjacent the first end, and a lower surface extending from the locking notch to a lower outer end. In some aspects, at least a portion of one of the upper surface and the lower surface is a curved, concave shape. The fastener assembly may also include a second structure comprising; a spherically shaped wall defining a second internal cavity and a locking tab extending from an outer surface of the spherically shaped wall, and shaped to mate with the locking notch. The fastener assembly may also include a magnet held within one of the first internal cavity and the second internal cavity; and a magnetically attractable material held within the other of the first internal cavity and the second internal cavity. As the first structure and the second structure near each other, the magnetically attractable material is attracted to the magnet, such that the spherically shaped wall of the second structure is guided at least partially by the curved, concave shaped portion of at least one of the upper surface or the lower surface of the first structure to align the locking tab with the locking notch. This, in turn, aligns a slider body of the zipper with both sets of interdigitating teeth, allowing the slider body to open and close the first and second slider tapes. Using such a fastener assembly, the first structure and the second structure are attracted to one another when within a certain distance. The guiding features of the fastener assembly align the first structure and the second structure with respect to each other, and other features maintain this aligned position, such that the closure mechanism is more easily used.

As seen in FIG. 1, a fastener assembly 10 is shown affixed to a garment having a first side panel 12 releasably coupled to a second side panel 14. In some aspects, the first side panel 12 includes a first slider tape 16 having a series of teeth 18. Similarly, the second side panel 14 may include a second slider tape 20 having a series of teeth 22. A slider body 24 is used to couple and uncouple teeth 18 with teeth 22 to couple and decouple the first side panel 12 to the second side panel 14. The fastener assembly 10 facilitates the initial alignment of the slider body 24, the first slider tape 16 and the second slider tape 20, allowing a user to more easily use the zipper on the garment, as is more fully-described below.

In aspects, a first structure 30 and a second structure 130 include features that individually and cooperatively contribute to properties and characteristics of the fastener assembly 10. Such aspects include complimentary and/or interconnected features that, in combination, afford coupling and decoupling characteristics to the fastener assembly 10. The relationships among these features are more easily explained and better appreciated with an independent understanding of the first structure 30 and the second structure 130. Thus, the first structure 30 and the second structure 130 are discussed individually below, followed by a use-case scenario.

Figure 2:
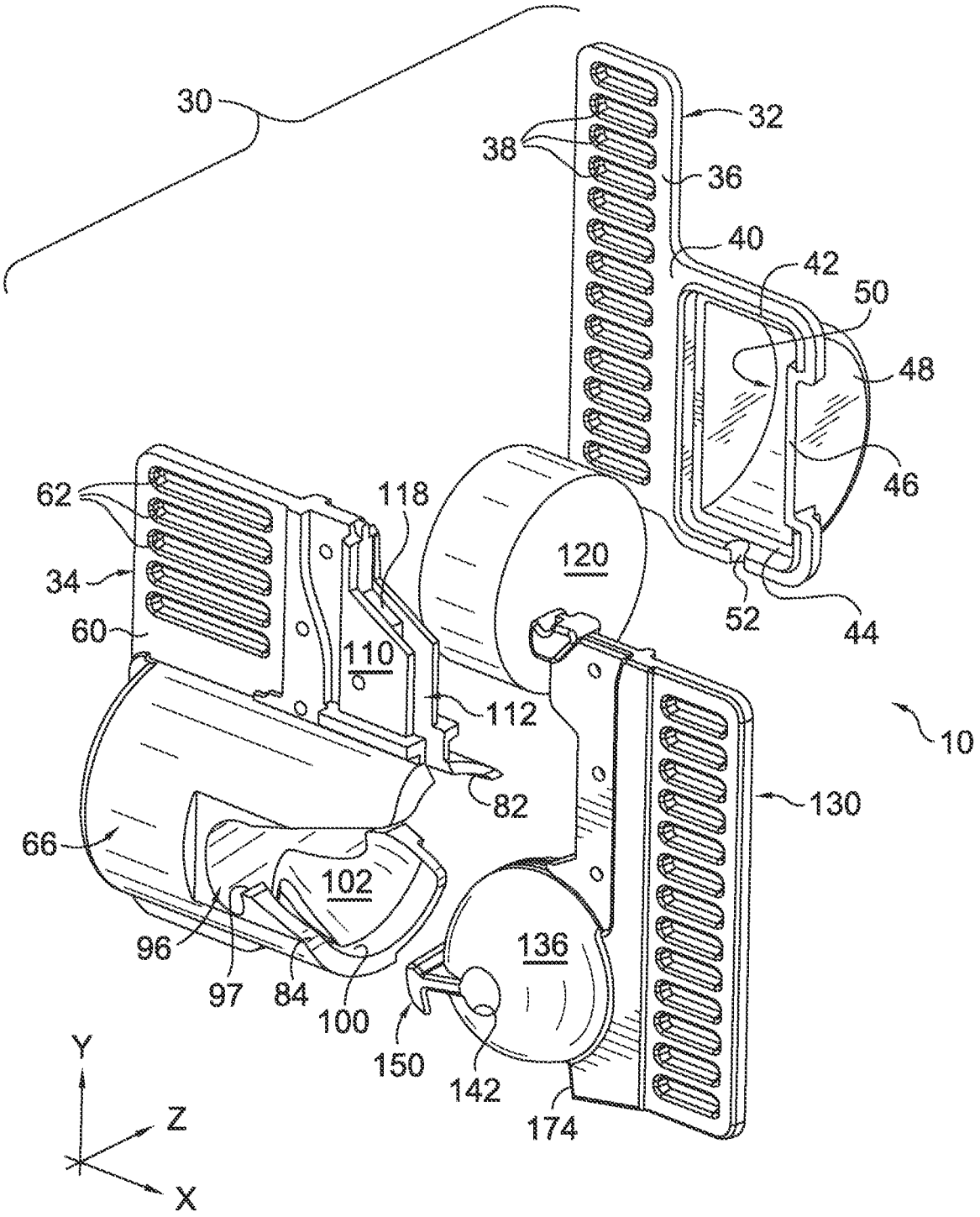
FIG. 2 illustrates an exploded perspective view of components of the fastener assembly of FIG. 1, shown without the zipper tape and garment portions, in accordance with aspects herein.
Figure 3:
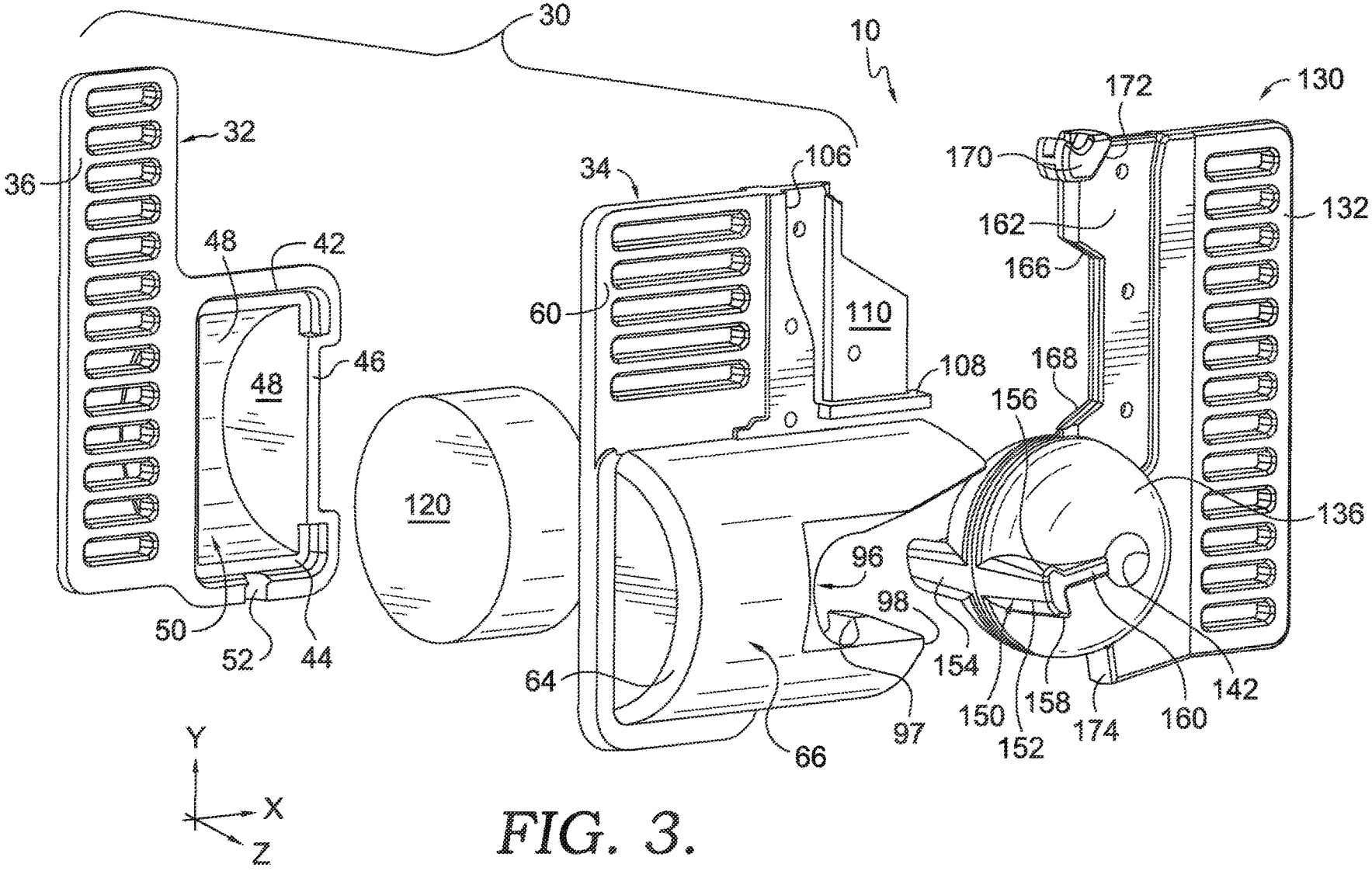
FIG. 3 illustrates an exploded perspective view similar to FIG. 2, but from a different perspective, in accordance with aspects herein.
Figure 7:
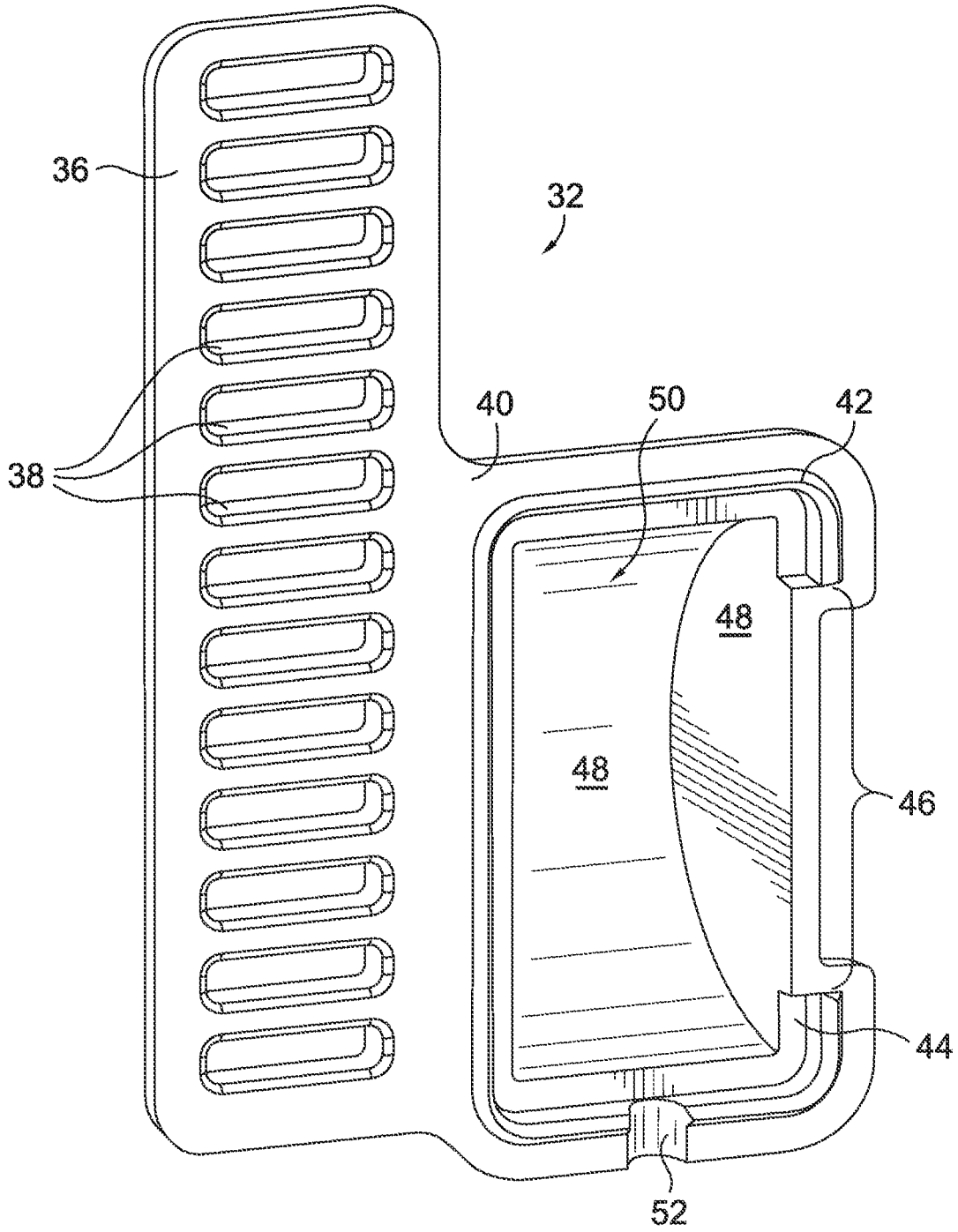
FIG. 7 illustrates a perspective view of a first body of the first structure, in accordance with aspects herein.

The fastener assembly 10 is shown in FIGS. 2 and 3 in an exploded view, and shown without being attached to the garment to reveal details of construction. The fastener assembly 10 includes the first structure 30 that aligns with the first slider tape 16. In some aspects, as shown in FIG. 2, the first structure 30 includes a first body 32 and a second body 34 that are coupled together, and that surround a magnet 120. In example aspects, the first body 32, the second body 34 and the second structure 130 (minus the ball 140) are constructed using a variety of injection moldable plastics or thermoplastics (such as, but not limited to, polyoxymethylene), or using three-dimensional printing techniques using materials such as polyamides, which include, but are not limited to nylon 12. The first body 32 is best seen in FIGS. 2, 3, and 7. In some aspects, the first body 32 includes a tab 36 having a series of slots 38 formed therein. The slots 38 are spaced from one another and allow the first body 32 to be coupled to the first side panel 12, such as by stitching (although other forms of attachment could be used). As best seen in FIG. 7, the first body 32 has a surface 40 that extends flush with the back surface of tab 36. A C-shaped rib 42 extends away from the surface 40, and a C-shaped channel 44 extends below the surface 40. The C-shaped rib 42 provides material to bond the first body 32 and the second body 34. The C-shaped rib 42 and the C-shaped channel 44 each define an open area or span 46 that is flush with surface 40 (with neither the rib 42 nor the channel 44 extending above or below the surface 40 in the area of span 46). The first body 32 also has a wall 48 that is shown having a semi-cylinder or half-cylinder shape, such that the wall 48 defines an internal cavity 50. As best seen in FIG. 7, in some aspects, the first body 32 includes an opening 52 at the bottom thereof that extends below the surface 40, through the C-shaped rib 42 and into the C-shaped channel 44, providing a passageway to the internal cavity 50.

Figure 8:
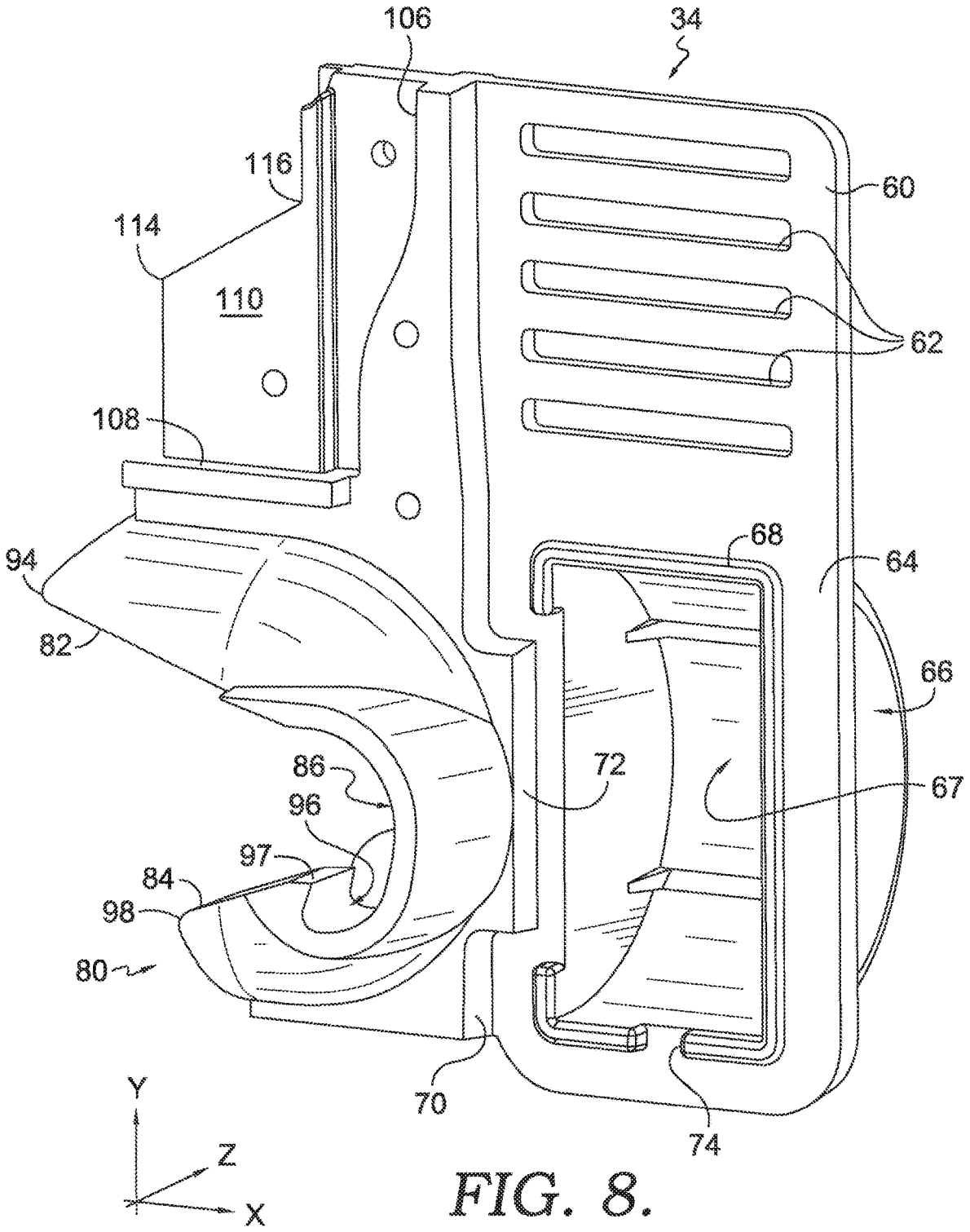
FIG. 8 illustrates a perspective view of a second body of the first structure, in accordance with aspects herein.
Figure 9:
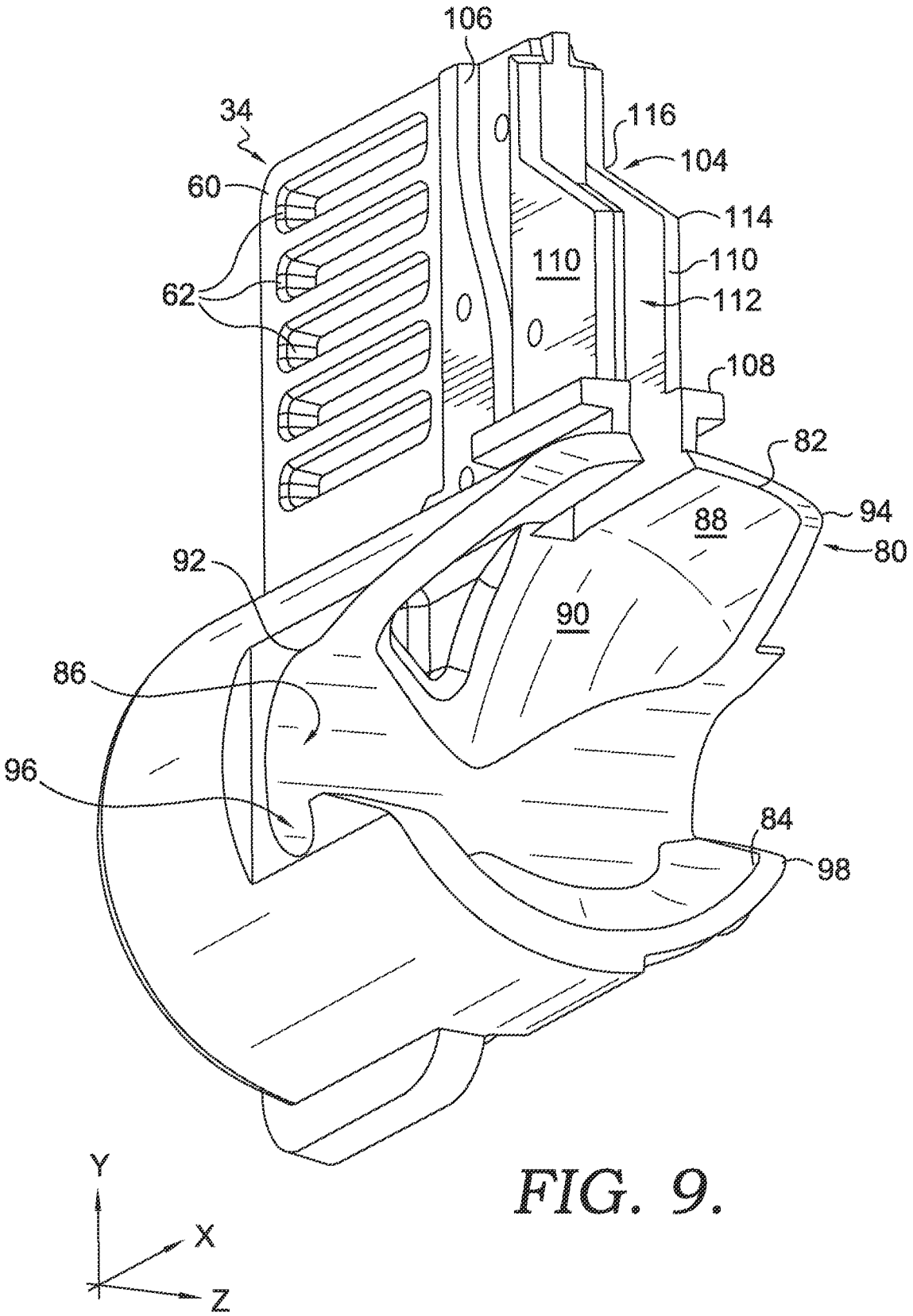
FIG. 9 illustrates a view of the second body of FIG. 8 from a different perspective, in accordance with aspects herein.

As seen in FIGS. 8 and 9, the second body 34 includes a tab 60 having a series of slots 62 formed therein. The slots 62 are spaced from one another and allow the second body 34 to be coupled to the first side panel 12, such as by stitching (although other forms of attachment could be used). A wall 64 extends below the tab 60, with one surface that is flush with the back of the tab 60. A part of the wall 64 extends outwardly to form a receptacle portion 66 of the wall 64, and defining an internal cavity 67, as best seen in FIG. 8. As shown, in some aspects, the receptacle portion 66 is semi-cylindrically or half-cylinder shaped (such that the cavity 50 and the cavity 67 may form a cylindrical cavity). The wall 64, in some aspects, includes a C-shaped rib 68 formed therein. The C-shaped rib 68 is sized and shaped to mate with the C-shaped channel 44 in the first body 32. As seen in FIG. 8, the second body 34, in some aspects, has a wall 70 extending outwardly from the back surface of tab 60, and includes a span 72 that fits within the opening of the C-shaped rib 42 of the first body 32 (extending across the span 46 of the first body 32). In some aspects, the C-shaped rib 68 includes an opening 74 that corresponds to the location of the opening 52 in the first body 32.

In some aspects, as seen in FIGS. 8 and 9, the second body 34 also includes a first alignment section or zone 80 extending away from the receptacle portion 66 along the x-axis. The first alignment section 80, in some aspects, includes an upper wall 82, a lower wall 84 and a locking notch 86 arranged between the upper wall 82 and the lower wall 84. The first alignment section 80 interacts with the second structure 130 to guide the second structure 130 into alignment with the first structure 30, and to maintain the coupled position of the first structure 30 and the second structure 130, as further described below. As best seen in FIG. 9, the interior surface of upper wall 82 may have a curved, concave shape. In some aspects, the interior surface of the upper wall 82 has a first portion 88 that forms a horizontal cylindrical segment. In some aspects, the interior surface of the upper wall 82 also includes a second portion 90 that forms a spherical cap. The interior surface of the upper wall 82 may extend from a first end 92 generally adjacent the locking notch 86 to an upper, outer end 94. The first portion 88 starts at the upper, outer end 94 and transitions to the second portion 90, which in turn extends to the first end 92. As seen in FIGS. 3 and 8, the locking notch 86 has a somewhat fish-hook shape with an open upper area that transitions to a lower area 96 with a hook shape. The interior surface of the lower wall 84 extends from a top 97 of the hook of the lower area 96, and terminates in a lower, outer end 98. As best seen in FIG. 2, the interior surface of the lower wall 84 may have a curved, concave shape. In some aspects, the interior surface of the lower wall 84 has a first portion 100 that forms a horizontal cylindrical segment. In some aspects, the interior surface of the lower wall 84 also includes a second portion 102 that forms at least a portion of a spherical cap.

The second body 34 also includes, in some aspects and as seen in FIG. 9, a second alignment zone or section 104 above the upper wall 82, and adjacent the tab 60. The second alignment section 104 has a first curved wall 106 that transitions to a lower shelf 108. The wall 106 and the shelf 108 provide a relief area for the slider body 24 (allowing the slider body 24 to be lowered against the shelf 108). The second alignment section 104 also includes a pair of spaced apart walls 110 that form a channel 112 therebetween. In some aspects, the top of the walls 110 are inclined from a first end 114 to a second end 116. Also, in some aspects, as seen in FIG. 2, an inclined stop surface 118 may extend between the walls 110, such that the channel 112 extends only partially from the first end 114 to the second end 116.

Figure 6:
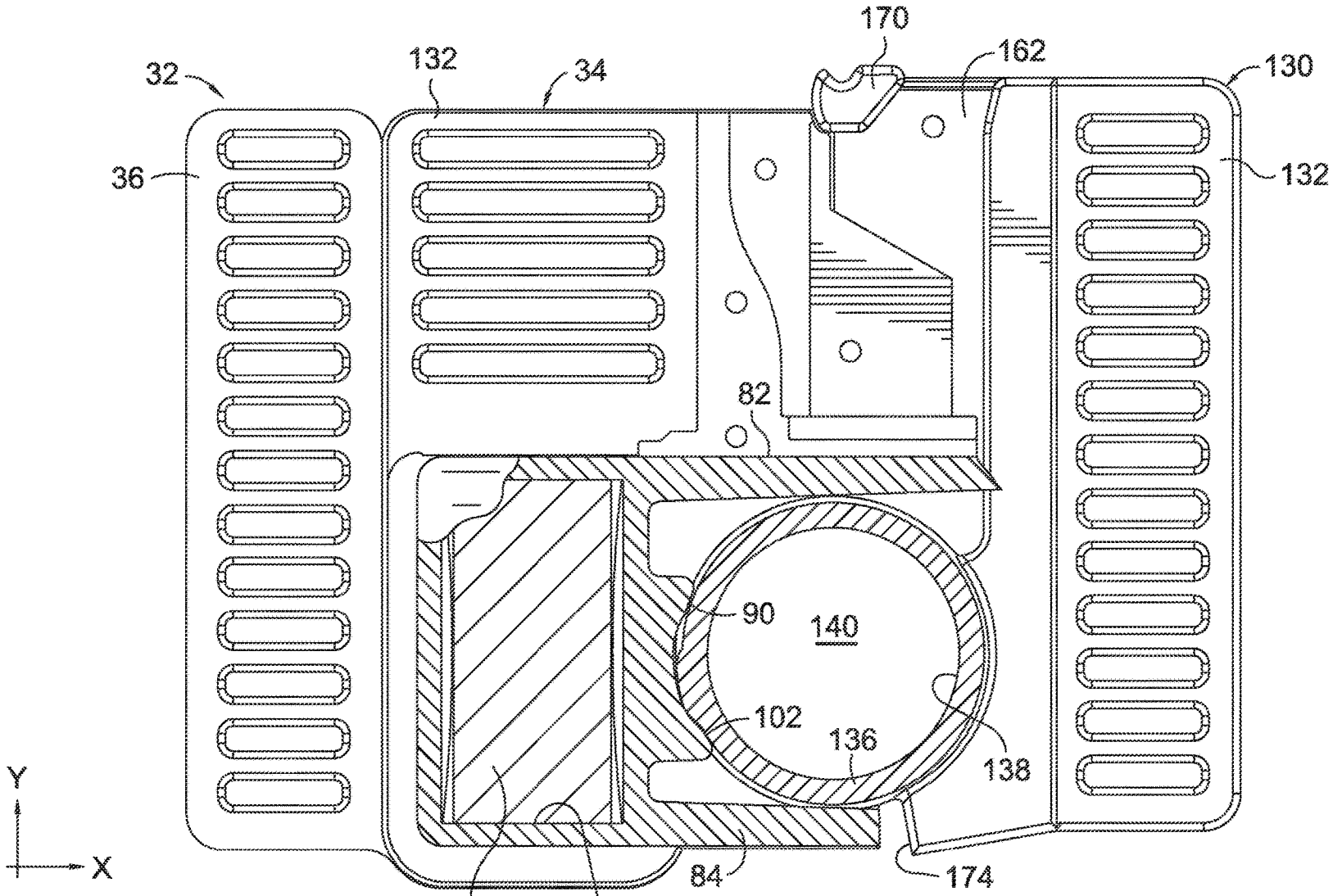
FIG. 6 illustrates a view of the components of the fastener assembly in the position of FIG. 4E, with portions broken away to reveal details of construction, in accordance with aspects herein.

As best seen in FIGS. 2, 3, and 6, the magnet 120 may be placed within the cavity 50 of the first body 32 and the cavity 67 of the second body 34. The first body 32 and the second body 34 are then coupled to one another, such as by sonically welding the first body 32 and the second body 34 along the C-shaped rib 42. Other attachment mechanisms could also be used to couple the first body 32 and the second body 34. Such a construction seals the first body 32 to the second body 34 about the magnet 120, except for the area of the span 46 and the span 72. This allows the magnet 120 to be placed in close proximity to the locking notch 86 (because of the lack of material needed for a weld bead in the area of the span 46 and span 72). With the magnet 120 in close proximity to the locking notch 86, a less powerful magnet can be used (as compared with a magnet needed if the area of the span 46 and the span 72 included a weld bead). However, this non-sealed area may allow liquids to penetrate into the area of the magnet 120 (the combined cavity 50 and cavity 67). The opening 52 and the open area 74 allow any such liquids to drain from the combined cavity 50 and cavity 67. In some aspects, only one of opening 52 and open area 74 are utilized (such that only one of the first body 32 and the second body 34 have a drain opening).

In some aspects, the magnet 120 has a cylinder shape to be held within the combined cavity 50 and cavity 67. The magnet 120 in some aspects includes at least one material that is magnetized and has a magnetic field. Examples of materials that may be included in and/or used to at least partially form the magnet 120 include but are not limited to neodymium alloy, iron, strontium, boron, or combinations thereof. In one aspect, the magnet 120 is a ceramic magnet (also known as a ferrite magnet). Related aspects contemplate that the magnet 120 may be a "neodymium magnet," which may also be referred to as a "rare earth magnet." As further described below, the magnet 120 attracts a magnetically attractable material held within the second structure 130. In some aspects, the magnet 120 has a coating disposed about the outer surface of the magnet to further protect the magnet.

Figure 4A:
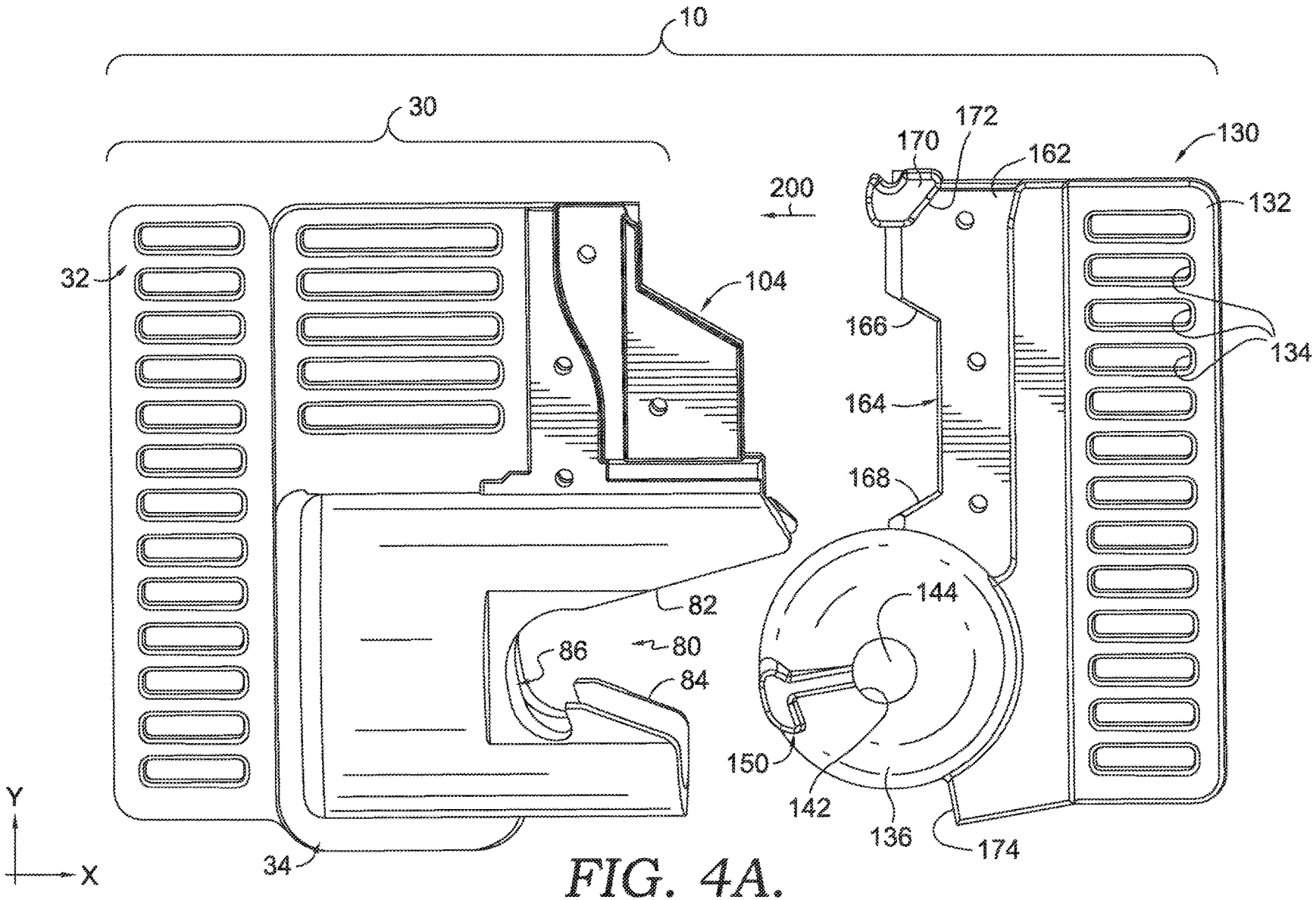
FIG. 4A illustrates a front view of the fastener assembly components in a first detached state, in accordance with aspects herein.

The fastener assembly 10 includes a second structure 130 that aligns with the second slider tape 20. In some aspects, as seen in FIG. 4A, the second structure 130 includes a tab 132 having a series of slots 134 formed therein. The slots 134 are spaced from one another and allow the second structure 130 to be coupled to the second side panel 14, such as by stitching (although other forms of attachment could be used). The second structure 130 also includes a spherically-shaped wall 136 adjacent the lower area of the tab 132. As seen in FIG. 6, the wall 136 forms an internal cavity 138. The internal cavity 138 is occupied by a magnetically attractable material. In some aspects, the cavity 138 is filled with a ball 140. The ball 140, in some aspects, includes at least one material that becomes magnetized when exposed to a magnetic field and becomes demagnetized when no longer exposed to the magnetic field. Materials that may be included in and/or used to at least partially form the ball 140 include but are not limited to iron, steel, carbon, aluminum, nickel, cobalt, manganese, silicon, or combinations thereof. In an example aspect, the ball 140 is formed of carbon steel. In some aspects, the ball 140 has an outer coating for protection. In some aspects, the structure 130 is formed by molding a material, such as a plastic material, around the ball 140. The wall 136 may also include opposed circular openings 142. In some aspects, the openings 142 are formed by parts of the mold holding the ball 140 in place during molding. The openings 142, in some aspects, are filled in with a material, or plug, 144, to seal the cavity 138.

As seen in FIG. 3, a locking tab 150 extends from the wall 136 (extending along the z-axis) at the outer diameter of the wall 136. In some aspects, the locking tab 150 has a first leg 152 and a second leg 154. In some aspects, the first leg 152 and the second leg 154 are mirror images of one another. Each of the first leg 152 and the second leg 154 have a curved upper end 156 and a curved lower end 158. In some aspects, the curved lower end 158 has a hook-shape that is sized and shaped to mate with the hook 96 in the first structure 30. As seen in FIG. 3, a wing 160 may extend rearwardly from the first leg 152 and the second leg 154 to the opening 142. The wing 160 may provide additional structural support for the first leg 152 and the second leg 154.

The second structure 130, in some aspects, also includes a rib 162 that extends above the wall 136 and away from the tab 132. As seen in FIG. 4A, the rib 162 includes a recessed area 164 that is defined at its upper boundary by an angled surface 166 and at its lower boundary by an angled surface 168. The rib 162 also supports a first tooth 170 that acts as the first tooth for the second slider tape 20. In some aspects, the first tooth 170 includes a lower, angled face 172. A lower wall 174 extends below the spherical wall 136, in some aspects. The lower wall 174 may be angled rearwardly from the top of lower wall 174 to the bottom on lower wall 174, as best seen in FIG. 4A.

In use, the first structure 30 may be coupled to the first side panel 12, and the second structure 130 may be coupled to the second side panel 14. The side panels 12 and 14 may form a portion of any article of apparel that has two portions designed to be joined and separated by a closure mechanism (such as a zipper). As used herein, the term "article of apparel" encompasses any number of products meant to be worn by a user including upper-body garments (e.g., shirts, jackets, hoodies, pullovers), lower-body garments (e.g., pants, shorts, leggings), articles of footwear such as shoes or socks, articles of headwear (e.g., hats), gloves, sleeves (e.g., arm sleeves, calf sleeves), and the like. Positional terms used when describing the article of apparel such as front, back, inner-facing surface, outer-facing surface, upper, lower, proximal, distal, medial, lateral, and the like are with respect to the article of apparel being worn as intended with the user standing upright.

FIGS. 4A-4F illustrate perspective views of the fastener assembly 10 and depict movement of the first structure 30 and second structure 130 to and between different positions. As shown in FIG. 4A, in an uncoupled state, the first structure 30 is away from the second structure 130. Beyond a "coupling distance," the magnetically attractable material of the ball 140 is beyond the magnetic field of the magnet 120. At the coupling distance, as used herein, the magnetically attractable material of the ball 140 is magnetically attracted to the magnet 120. In one aspect, the coupling distance is about 2.5 cm. As used herein and when referring to the coupling distance, the term "about" means ±0.5 cm. The coupling distance may vary based upon the strength of magent 120, and upon the materials used for the ball 140. FIG. 4A depicts a position in which the first structure 30 and the second structure 130 are uncoupled and separated from one another beyond the coupling distance. At this point, a user can move the first structure 30 towards the second structure 130 (such as by grasping one of the first structure 30 or the second structure 130 and moving it towards the other of the first structure 30 and the second structure 130).

Figure 4B:
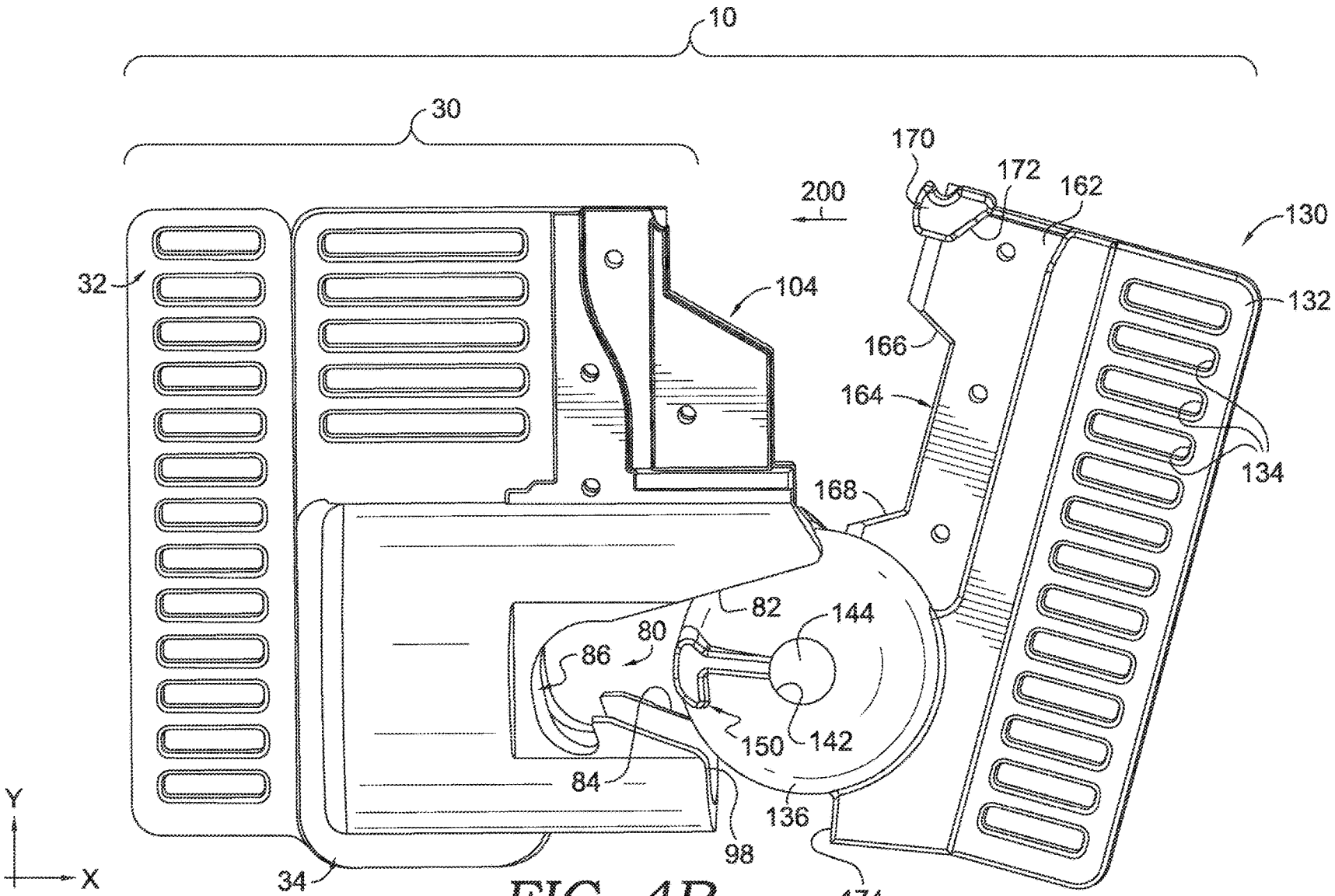
FIG. 4B illustrates a front view similar to FIG. 4A, but with the first structure and second structure moved closer together, and with the second structure rotated slightly, in accordance with aspects herein.
Figure 4C:
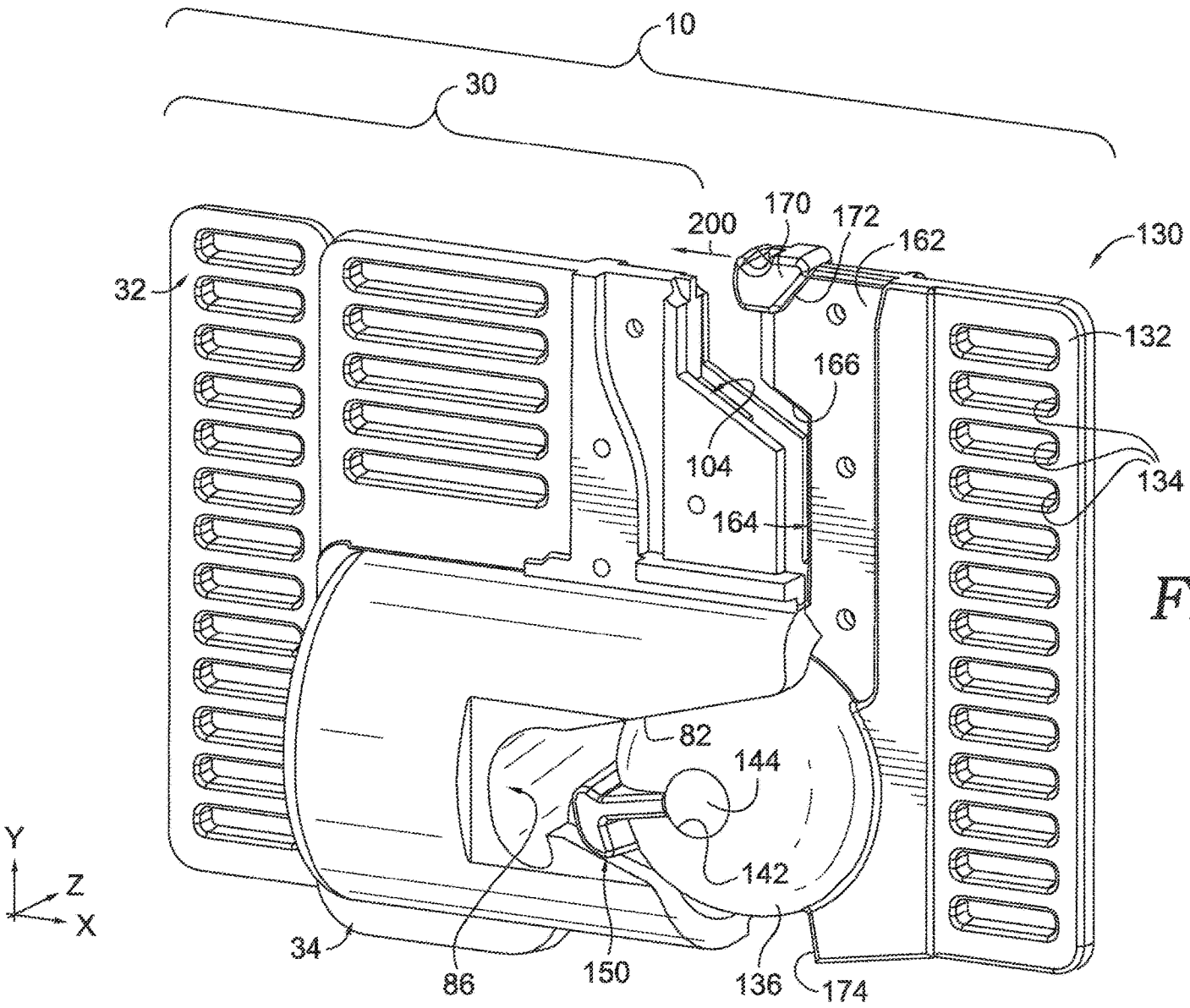
FIG. 4C illustrates a front view similar to FIG. 4B, but with the second structure rotated more upright (with respect to FIG. 4B) about the z-axis, in accordance with aspects herein.
Figure 4D:
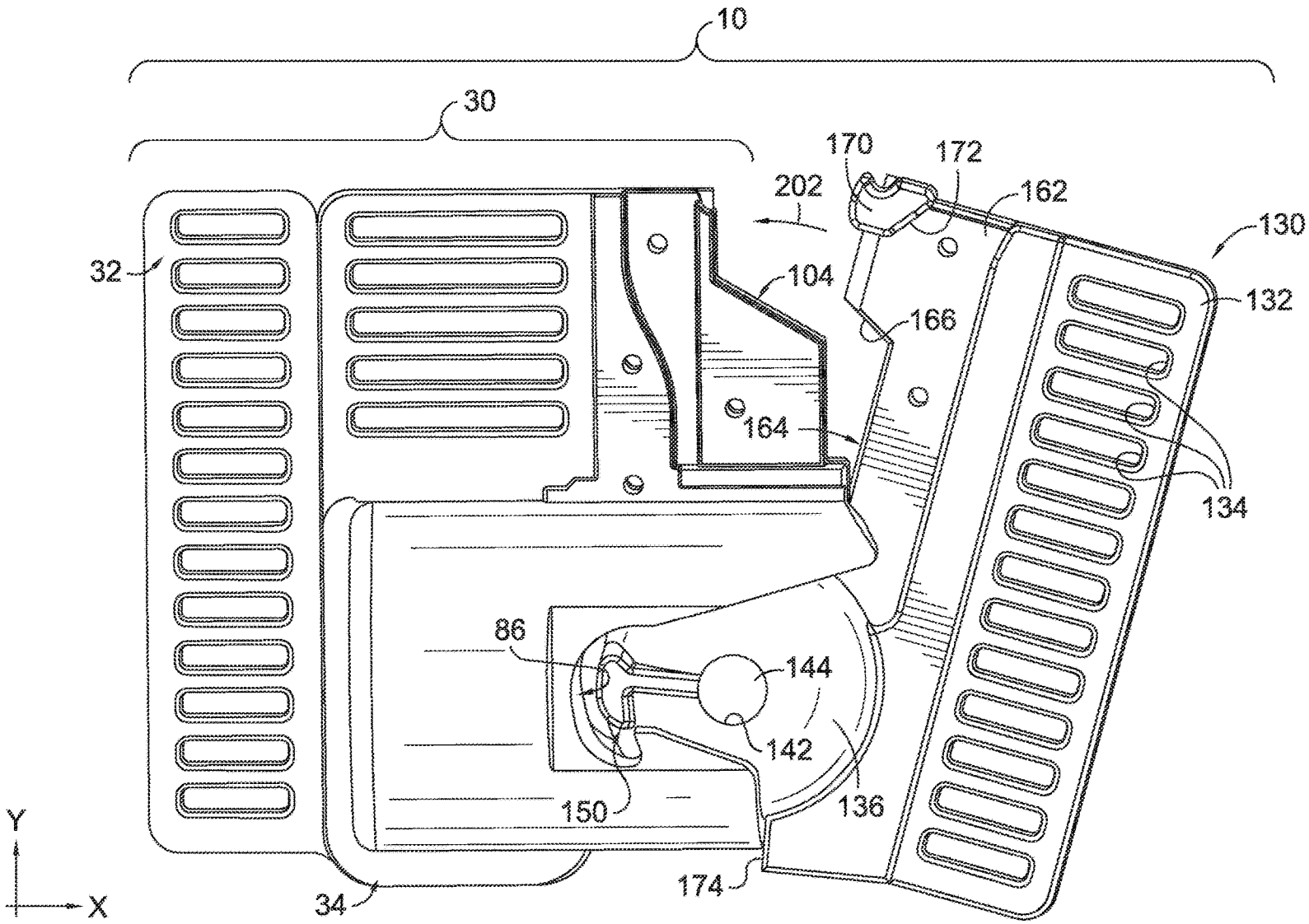
FIG. 4D illustrates a front view similar to FIG. 4B, but with second structure moved farther within the first structure, in accordance with aspects herein.
Figure 4E:
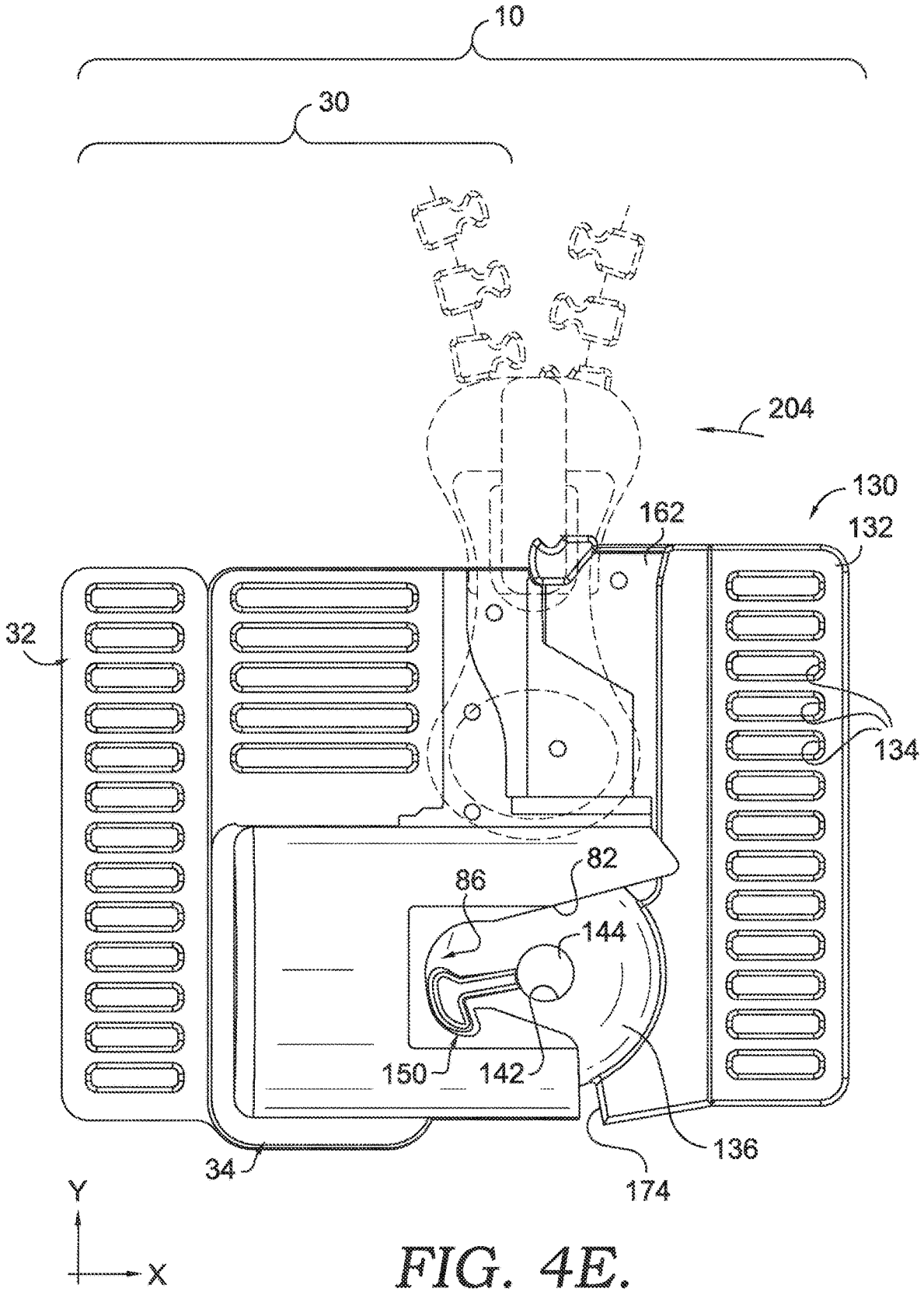
FIG. 4E illustrates a front view similar to FIG. 4D, but with the second structure rotated farther, with the locking tab seated within the locking notch, and with the slider body in a lowered position, in accordance with aspects herein.
Figure 4F:
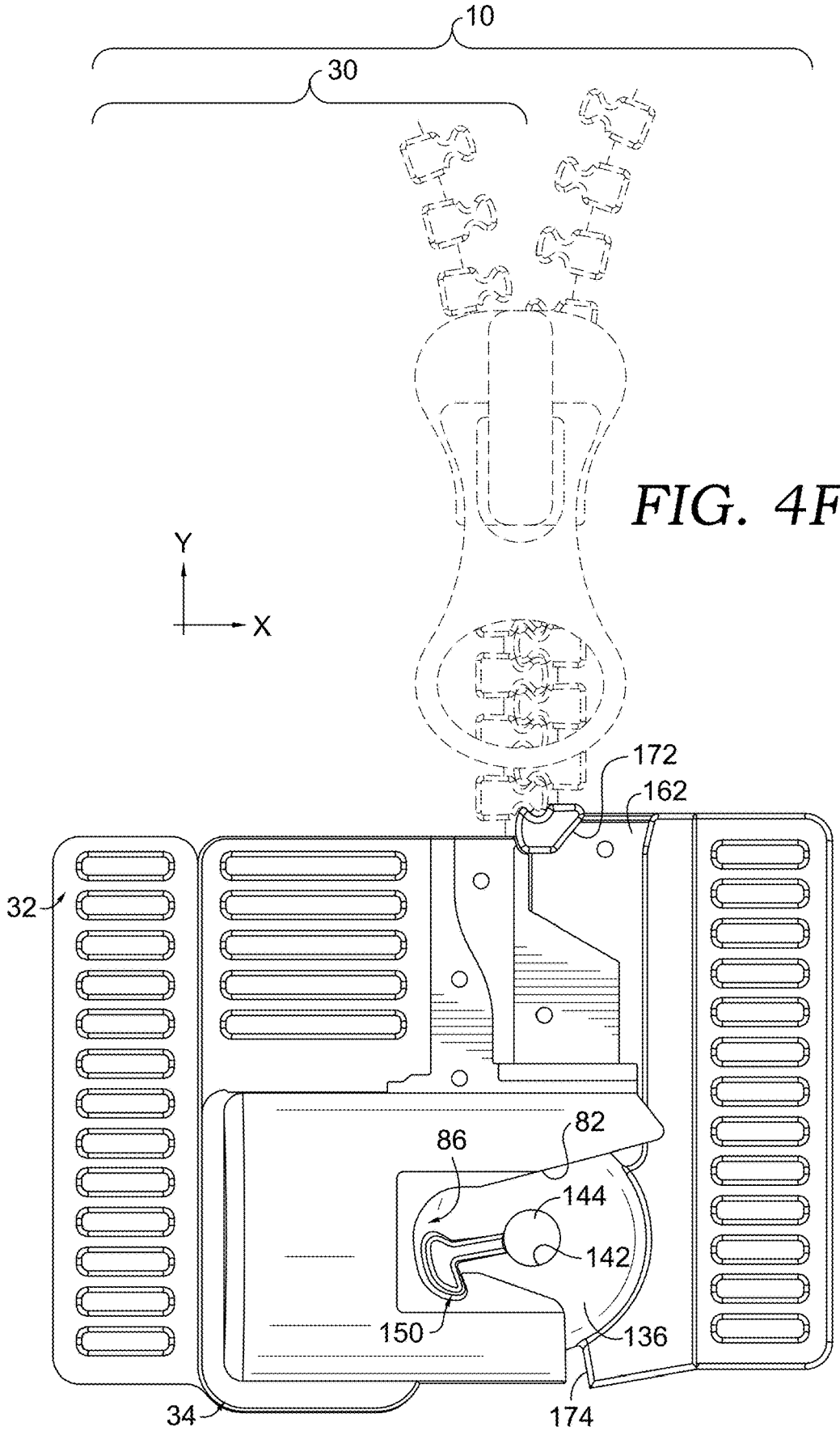
FIG. 4F illustrates a front view similar to FIG. 4E, but with the slider body at least partially raised, in accordance with aspects herein
Figure 5:
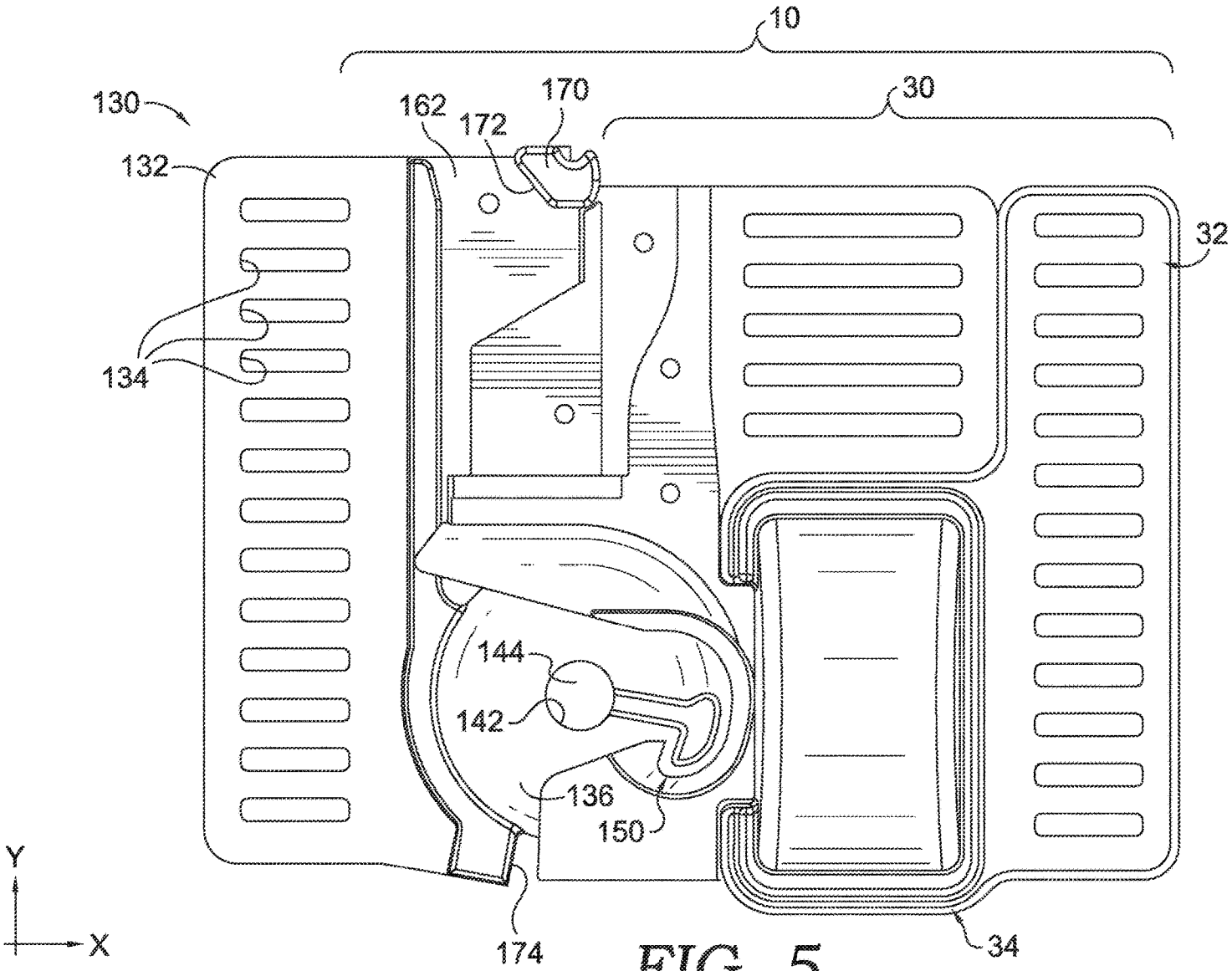
FIG. 5 illustrates a rear view of the components of the fastener assembly, in the position of FIG. 4E, in accordance with aspects herein.

As seen in FIGS. 4B-4D, as the second structure 130 is moved toward the first structure 30, within the coupling distance, the magnet 120 attracts the magnetically attractable material in the ball 140, pulling the first structure 30 and the second structure 130 toward one another. The wall 136 and/or the locking tab 150 are guided into alignment with the first structure 30 by the alignment section 80. In the alignment section 80, the upper wall 82 and the lower wall 84 can interact with the wall 136 and the locking tab 150 to guide the locking tab 150 into alignment with the locking notch 86. In some aspects, the upper wall 82 and the lower wall 82 can contact the wall 136 and/or the locking tab 150 to orient the second structure 130 rotationally in the x-y plane about the z-axis. As seen in FIG. 4D, the lower wall 174 may abut the lower outer end 98 of the lower wall 84, limiting the angular orientation of the second structure 130 with respect to the first structure 30. Additionally, the rib 162 of the second structure 130 is guided into alignment with the channel 112. Once the rib 162 is within the channel 112, the first structure 30 and the second structure 130 are held in position with respect to each other along the z-axis. Again, once the second structure 130 is within the coupling distance, the magnet 120 attracts the ball 140, such that the magnet 120 attracts, or pulls, the second structure 130 into the alignment section 80 and the alignment section 104. The wall 136 surrounding the ball 140, in some aspects, contacts the second portion 90 of the upper wall 82 and the second portion 102 of the lower wall 84. Therefore, once within the coupling distance, the magnet 120 attracts the ball 140, to move the first structure 30 and the second structure 130 into the position shown in FIG. 4E with the locking tab 150 aligned with the locking notch 86. In this position, the slider body 24 can by lowered by the user to abut the lower shelf 108. A user or wearer of a garment having the fastener assembly 10 is thus able to move the second structure 130 within the coupling distance of the first structure 30, and the guiding features (i.e. the upper wall 82, the lower wall 84, the wall 136 and the locking tab 150) self-align the first structure 30 with respect to the second structure 130, and maintain the relative positions of the first structure 30 and the second structure 130. With the first structure 30 and the second structure 130 in the position of FIG. 4E, and with the slider body 24 against the lower shelf 108, the lower ends of the first slider tape 16 and the second slider tape 20 are in an aligned position, such that the user can move the slider body 24 upwardly. The initial upward movement of the slider body 24 acts upon the lower angled face 174 of the first tooth 172, causing a final rotational movement of the second structure 130 about the z-axis (in a counterclockwise direction, as viewed in FIG. 4E), to positively move the lower end 158 of the locking tab 150 into engagement with the lower end of the hook 96 in locking notch 86. Over-rotation is prevented, as the incline surface 166 contacts the stop surface 118. Such a structure, and positioning, prevents the first structure 30 from disengagement with the second structure 130, until the slider body 24 is returned to a position abutting the lower shelf 108.

The fastener assembly 10 can therefore be seen as providing a releasable closure mechanism with alignment and locking features that assist a user in properly aligning the first structure 30 and the second structure 130, such that the slider body 24 is in position to couple and decouple the first side panel 12 to the second side panel 14. Once a user manipulates the first structure 30 to be within the coupling distance of the second structure 130 (or manipulates the second structure 130 to be within the coupling distance of the first structure 30), the magnet 120 in the first structure 30 attracts the magnetically attractable material (ball 140) within the second structure 130. As the structure 130 is pulled toward structure 30, the locking tab 150 is guided into alignment with the locking notch 86, and the rib 162 is guided into alignment with the channel 112. The wall 136 may interact with the spherical caps 90 and 102 to further align the structure 130 with respect to the structure 30. Once aligned, the user is able to operate the slider body 24 to couple and decouple the teeth 18 and 22 (allowing the side panel 12 to be releasably coupled to the side panel 14). The fastener assembly 10 thus provides a wearer with an assembly that is easy to use, even with limited dexterity or mobility.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A fastening assembly for a zipper having a first slider tape and a second slider tape, each slider tape including a series of interdigitating teeth along a zipper axis, the fastener assembly comprising: a first structure comprising; a first portion defining a first internal cavity; and a second portion defining a first alignment zone, the second portion having a first end adjacent the first internal cavity, an upper surface extending from the first end to an upper outer end, a locking notch adjacent the first end, and a lower surface extending from the locking notch to a lower outer end, wherein at least a portion one of the upper surface and the lower surface is a curved, concave shape; and a second structure comprising; a spherically shaped wall defining a second internal cavity; a locking tab extending from an outer surface of the spherically shaped wall, the locking tab shaped to mate with the locking notch; a magnet held within one of the first internal cavity and the second internal cavity; and a magnetically attractable material held within the other of the first internal cavity and the second internal cavity; wherein as the first structure and the second structure near each other, the magnetically attractable material is attracted to the magnet, such that the spherically shaped wall of the second structure is guided at least partially by at least the curved, concave shaped portion of one of the upper surface or the lower surface of the first structure to align the locking tab with the locking notch.

Clause 2. The fastening assembly of clause 1, wherein the first structure further comprises a second alignment zone spaced from the first alignment zone, the second alignment zone having a channel aligned in parallel with the zipper axis, and wherein the second structure further comprises a rib spaced from the spherically shaped wall, and aligned in parallel with the zipper axis, wherein the channel engages the rib when the locking tab is held within the locking notch.

Clause 3. The fastening assembly of any of clauses 1-2, wherein the zipper axis defines a y-axis, and wherein the channel and the rib, when engaged, prevent movement of the first structure relative to the second structure along a z-axis orthogonal to the y-axis.

Clause 4. The fastening assembly of any of clauses 1-3, wherein the first structure further comprises a slotted tab adjacent the first internal cavity and spaced from the second portion.

Clause 5. The fastening assembly of any of clauses 1-4, wherein the second structure further comprises a slotted tab adjacent the spherically shaped wall and spaced from the locking tab.

Clause 6. The fastening assembly of any of clauses 1-5, wherein the locking tab extends in a direction along the z-axis.

Clause 7. The fastening assembly of any of clauses 1-6, wherein the second structure further comprises a first tooth of the zipper integral to the second structure, along the zipper axis and above the second mating structure.

Clause 8. The fastening assembly of any of clauses 1-7, wherein the zipper includes a slider body, and wherein the first tooth includes an angled cam surface positioned to interact with the slider body upon upward movement of the slider body, the interaction of the cam surface and the slider body rotating the second structure to seat the locking tab in the locking notch.

Clause 9. The fastening assembly of any of clauses 1-8, wherein the magnetic field of the magnet attracts the magnetically attractable material along an x-axis, in a direction orthogonal to the y-axis and the z-axis.

Clause 10. The fastening assembly of claim 9, wherein engagement of the locking tab into the locking notch prevents movement of the first structure with respect to the second structure along the x-axis.

Clause 11. The fastening assembly of any of clauses 1-10, wherein the first structure is a two-piece structure, each piece of the two-piece structure defining a portion of the first internal cavity.

Clause 12. The fastening assembly of any of clauses 1-11, wherein the first internal cavity is defined by a c-shaped weld bead joining the two pieces of the two-piece structure.

Clause 13. The fastening assembly of any of clauses 1-12, wherein the c-shaped weld bead includes an open, non-welded area adjacent the first end of the first alignment zone.

Clause 14. The fastening assembly of any of clauses 1-13, wherein at least one piece of the two-piece structure includes an opening at the bottom of the internal cavity.

Clause 15. The fastening assembly of any of clauses 1-14, wherein the magnetically attractable material is a magnet.

Clause 16. The fastening assembly of any of clauses 1-15, wherein, with the spherically shaped wall of the second structure adjacent the first end of the second portion of the first structure, the first structure and the second structure are rotatable about a z-axis extending through the center of the spherically shaped wall.

Clause 17. The fastening assembly of any of clauses 1-16, wherein the spherically shaped wall comprises a pair of holes aligned along the z-axis.

Clause 18. The fastening assembly of any of clauses 1-17, wherein the pair of holes are plugged to form a seal, preventing access to the second internal cavity.

Clause 19. The fastening assembly of any of clauses 1-18, wherein at least one of the magnet and the magnetically attractable material have an outer coating surrounding the at least one of the magnet and the magnetically attractable material.

Clause 20. The fastening assembly of any of clauses 1-19, wherein at least one of the first structure and the second structure are molded from a thermoplastic material.

Clause 21. The fastening assembly of any of clauses 1-20, wherein the upper surface and the lower surface of the second portion of the first structure center the spherically shaped wall of the second structure about an x-axis aligned with the center of the second portion of the first structure.

Clause 22. The fastening assembly of any of clauses 1-21, wherein the locking tab is symmetrical about a vertical plane extending through the spherically shaped wall along the x-y axes.

Clause 23. The fastening assembly of any of clauses 1-22, where the two pieces of the first structure are asymmetrical with respect to each other.

Clause 24. A zipper comprising the fastening assembly of any of clauses 1-23.

Clause 25. A garment comprising the fastening assembly of any of clauses 1-23.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A fastening assembly for a zipper having a first slider tape and a second slider tape, each slider tape including a series of interdigitating teeth along a zipper axis, the fastener assembly comprising:

a first structure comprising;

a first portion defining a first internal cavity; and a second portion defining a first alignment zone, the second portion having a first end adjacent the first internal cavity, an upper surface extending from the first end to an upper outer end, a locking notch adjacent the first end, and a lower surface extending from the locking notch to a lower outer end, wherein at least a portion of one of the upper surface and the lower surface is a curved, concave shape; and a second structure comprising;

a spherically shaped wall defining a second internal cavity;

a locking tab extending from an outer surface of the spherically shaped wall, the locking tab shaped to mate with the locking notch;

a magnet held within one of the first internal cavity and the second internal cavity; and a magnetically attractable material held within the other of the first internal cavity and the second internal cavity;

wherein when the first structure and the second structure are near each other, the magnetically attractable material is attracted to the magnet, such that the spherically shaped wall of the second structure is guided at least partially by at least the curved, concave shaped portion of one of the upper surface or the lower surface of the first structure to align the locking tab with the locking notch.

2. The fastening assembly of claim 1, wherein the first structure further comprises a second alignment zone spaced from the first alignment zone, the second alignment zone having a channel aligned in parallel with the zipper axis, and wherein the second structure further comprises a rib spaced from the spherically shaped wall, and aligned in parallel with the zipper axis, wherein the channel engages the rib when the locking tab is held within the locking notch.

3. The fastening assembly of claim 2, wherein the zipper axis defines a y-axis, and wherein the channel and the rib, when engaged, prevent movement of the first structure relative to the second structure along a z-axis orthogonal to the y-axis.

4. The fastening assembly of claim 3, wherein a magnetic field of the magnet attracts the magnetically attractable material along an x-axis, in a direction orthogonal to the y-axis and the z-axis.

5. The fastening assembly of claim 4, wherein engagement of the locking tab into the locking notch prevents movement of the first structure with respect to the second structure along the x-axis.

6. The fastening assembly of claim 4, wherein the locking tab is symmetrical about a vertical plane extending through the spherically shaped wall along the x-y axes.

7. The fastening assembly of claim 2, wherein the second structure further comprises a first tooth of the zipper integral to the second structure, along the zipper axis and above the rib.

8. The fastening assembly of claim 7, wherein the zipper includes a slider body, and wherein the first tooth includes an angled cam surface positioned to interact with the slider body upon upward movement of the slider body, the interaction of the angled cam surface and the slider body rotating the second structure to seat the locking tab in the locking notch.

9. The fastening assembly of claim 2, wherein the spherically shaped wall comprises a pair of holes aligned along a z-axis.

10. The fastening assembly of claim 9, wherein the pair of holes are plugged to form a seal, preventing access to the second internal cavity.

11. The fastening assembly of claim 1, wherein the first structure further comprises a slotted tab adjacent the first internal cavity and spaced from the second portion.

12. The fastening assembly of claim 1, wherein the second structure further comprises a slotted tab adjacent the spherically shaped wall and spaced from the locking tab.

13. The fastening assembly of claim 1, wherein the zipper axis defines a y-axis, and wherein the locking tab extends in a direction along a z-axis orthogonal to the y-axis.

14. The fastening assembly of claim 1, wherein the first structure is a two-piece structure, each piece of the two-piece structure defining a portion of the first internal cavity.

15. The fastening assembly of claim 14, wherein the first internal cavity is defined by a c-shaped weld bead joining each piece of the two-piece structure.

16. The fastening assembly of claim 15, wherein the c-shaped weld bead includes an open, non-welded area adjacent the first end of the first alignment zone.

17. The fastening assembly of claim 16, wherein at least one piece of the two-piece structure includes an opening at a bottom of the internal cavity.

18. The fastening assembly of claim 14, wherein each piece of the two-piece structure is asymmetrical with respect to each other.

19. The fastening assembly of claim 1, wherein the magnetically attractable material is a magnet.

20. The fastening assembly of claim 1, wherein, with the spherically shaped wall of the second structure adjacent the first end of the second portion of the first structure, the first structure and the second structure are rotatable about a z-axis extending through a center of the spherically shaped wall.

21. The fastening assembly of claim 1, wherein at least one of the magnet and the magnetically attractable material have an outer coating surrounding the at least one of the magnet and the magnetically attractable material.

22. The fastening assembly of claim 1, wherein at least one of the first structure and the second structure are molded from a thermoplastic material.

23. The fastening assembly of claim 1, wherein the upper surface and the lower surface of the second portion of the first structure center the spherically shaped wall of the second structure about an x-axis aligned with a center of the second portion of the first structure.

24. A zipper comprising the fastening assembly of any of claims 1-18.

25. A garment comprising the fastening assembly of any of claims 1-18.

* * * * *